US006672067B2

(12) United States Patent
Farmer et al.

(10) Patent No.: US 6,672,067 B2
(45) Date of Patent: Jan. 6, 2004

(54) CORRUGATED COWL FOR COMBUSTOR OF A GAS TURBINE ENGINE AND METHOD FOR CONFIGURING SAME

(75) Inventors: Gilbert Farmer, Cincinnati, OH (US); Ronald D. Redden, Foster, KY (US); Balena B. Shorter, Hamilton, OH (US); James A. Groeschen, Burlington, KY (US); Mehmet M. Dede, West Chester, OH (US); Daniel L. Durstock, Fort Wright, KY (US)

(73) Assignee: General Electric Company, Schenectady, NY (US)

( * ) Notice: Subject to any disclaimer, the term of this patent is extended or adjusted under 35 U.S.C. 154(b) by 50 days.

(21) Appl. No.: 10/085,767

(22) Filed: Feb. 27, 2002

(65) Prior Publication Data

US 2003/0159445 A1 Aug. 28, 2003

(51) Int. Cl.[7] ..... F02C 1/00
(52) U.S. Cl. ..... 60/752; 60/748
(58) Field of Search ..... 60/752, 748, 796

(56) References Cited

U.S. PATENT DOCUMENTS 3,854,285 A * 12/1974 Stenger et al. ..... 60/39.66
4,606,190 A * 8/1986 Greene et al. ..... 60/39.23
5,181,377 A * 1/1993 Napoli et al. ..... 60/39.31
5,197,290 A * 3/1993 Lee et al. ..... 60/748
5,924,288 A * 7/1999 Fortuna et al. ..... 60/752
6,148,600 A 11/2000 Farmer et al.
6,212,870 B1 * 4/2001 Thompson et al. ..... 60/39.02
2002/0178728 A1 * 12/2002 McCaffrey et al. ..... 60/752

FOREIGN PATENT DOCUMENTS

GB 2039359 A * 8/1980
JP 405113218 A * 5/1993

* cited by examiner

*Primary Examiner*—Justin R. Yu
*Assistant Examiner*—John F. Belena
(74) *Attorney, Agent, or Firm*—William Scott Andes; Cantor Colburn LLP

(57) ABSTRACT

A cowl for use with a combustor of a gas turbine engine, the cowl includes a main body with an annular corrugation. A combustor of a gas turbine engine, the combustor includes: a hollow body defining a combustion chamber, the hollow body having a liner; an outer cowl having an annular corrugation, the cowl connecting to the liner; and an inner cowl connecting to the liner. A method of configuring a cowl for a gas turbine engine combustor, the method includes forming an annular corrugation in a main body of the cowl.

31 Claims, 6 Drawing Sheets

CORRUGATED COWL FOR COMBUSTOR OF A GAS TURBINE ENGINE AND METHOD FOR CONFIGURING SAME

BACKGROUND OF THE INVENTION

In a gas turbine engine, pressurized air is provided from the compressor stage to the combustor, whereupon it is mixed with fuel and is burned in the combustion chamber. The amount of pressurized air that enters the fuel/air mixers, and correspondingly the inner and outer passages of the combustor, has typically been regulated by inner and outer cowls located upstream of the fuel/air mixers and the combustor dome. Such cowls have been generally held in place by means of a bolted joint that includes the combustor dome, the cowl, and either the inner or outer combustor liner. Accordingly, both the outer and inner cowls of a gas turbine engine experience a slight change in pressure thereacross, as well as a vibratory load induced by the engine. While these environmental factors have a greater effect on the outer cowl, they nevertheless cause wear on both cowls and consequently limit the life thereof.

In addressing this problem, the prior art has generally taken one of the following approaches. The first of which involves use of a sheet metal body for the cowls with a lip formed at the leading edge thereof, preferably by curling or wrapping the sheet metal around a damper wire. However, it has been found that this design is life-limited due to a rubbing-type wear occurring at the interface of the wire and the sheet metal body caused by a thermal mismatch between the wire and the wrap. More specifically, the thermal mismatch causes the sheet metal to unwrap around the wire, creating a gap between the wire and the cowl. In addition, white noise exiting the diffuser and/or combustor acoustics creates high cycle fatigue vibratory loading of the wire against the sheet metal wrap. Thus, the combined rubbing and vibratory induced shaking of the wire against the metal wrap result in the wrapped portion of the cowl thinning, cracking and eventually liberating sheet metal and wire fragments.

Another cowl design involves a machined ring that forms the leading edge lip of the cowl, where the ring is welded to a formed sheet metal body. Such a machined ring provides a solid lip for the cowl, which is desirable, but circumferential welding thereof to the formed sheet metal body has resulted in stress concentrations both in and around the weld.

A one-piece cowl design is disclosed in a U.S. patent application entitled "One-Piece Combustor Cowl," U.S. Pat. No. 5,924,288, which discloses a cowl that is casted with a solid lip of increased thickness at a leading edge thereof. While suitable for its intended purpose, this cowl tends to be both heavier and more costly than a sheet metal cowl.

SUMMARY OF THE INVENTION

The above discussed and other drawbacks and deficiencies are overcome or alleviated by a corrugated cowl. In an exemplary embodiment of the invention, a cowl for use with a combustor of a gas turbine engine, the cowl includes a main body with an annular corrugation. In another exemplary embodiment a combustor of a gas turbine engine, the combustor includes: a hollow body defining a combustion chamber, the hollow body having a liner; an outer cowl having an annular corrugation, the cowl connecting to the liner; and an inner cowl connecting to the liner. A method of configuring a cowl for a gas turbine engine combustor, the method includes forming an annular corrugation in a main body of the cowl.

DESCRIPTION OF THE DRAWING

Referring to the exemplary drawings wherein like elements are numbered alike in the several Figures.

DETAILED DESCRIPTION OF THE INVENTION

Figure 1:
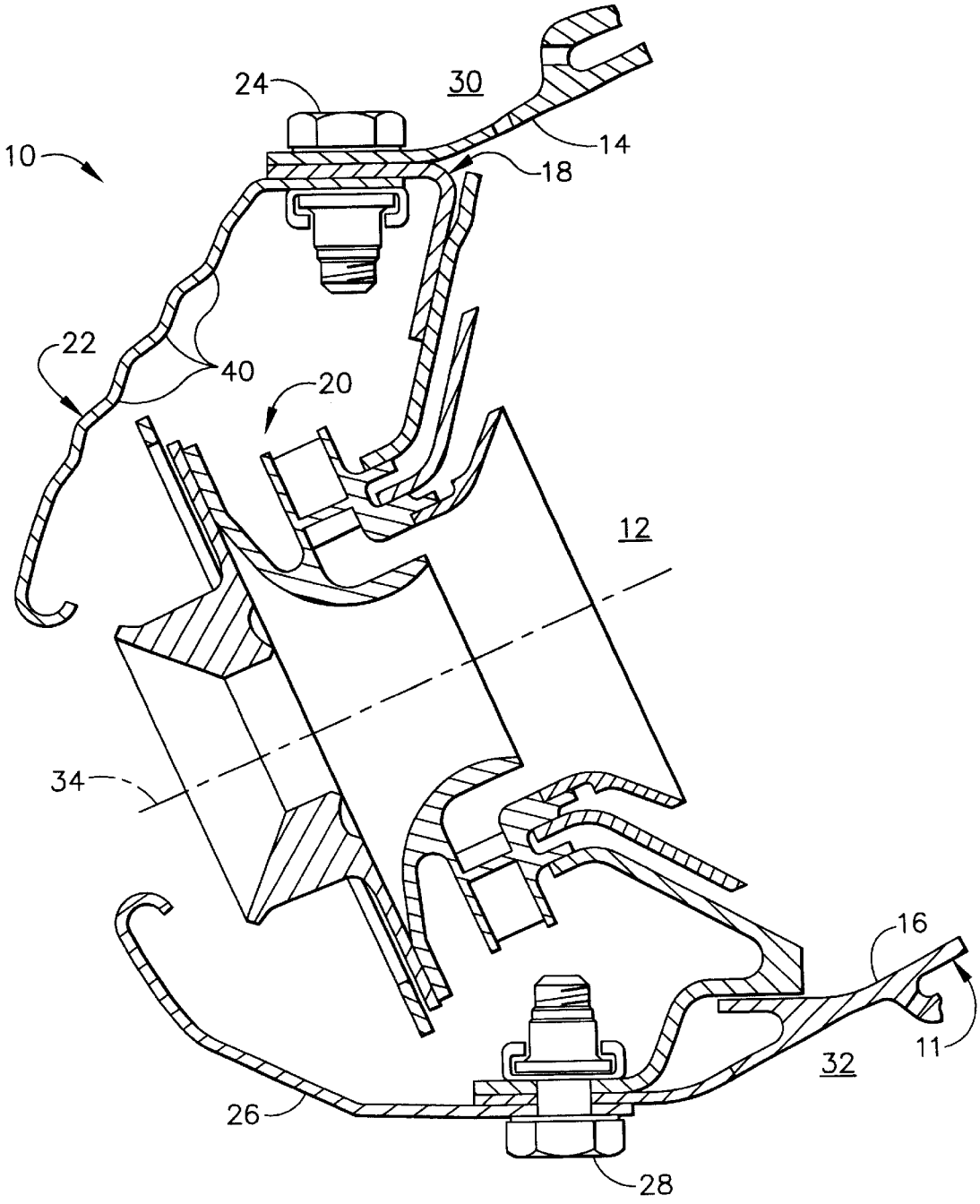
FIG. 1 is a longitudinal cross-sectional view of a gas turbine engine combustor including an outer cowl with annular corrugations and an inner cowl.

Referring now to FIG. 1, a single annular combustor 10 suitable for use in a gas turbine engine is illustrated. Combustor 10 includes a hollow body 11 that defines a combustion chamber 12 therein. Hollow body 11 is generally annular in form and includes an outer liner 14, an inner liner 16, and a domed end or dome 18. In the present annular configuration, domed end 18 of hollow body 11 further includes a plurality of air/fuel mixers 20 of known design spaced circumferentially therearound.

Figure 2:
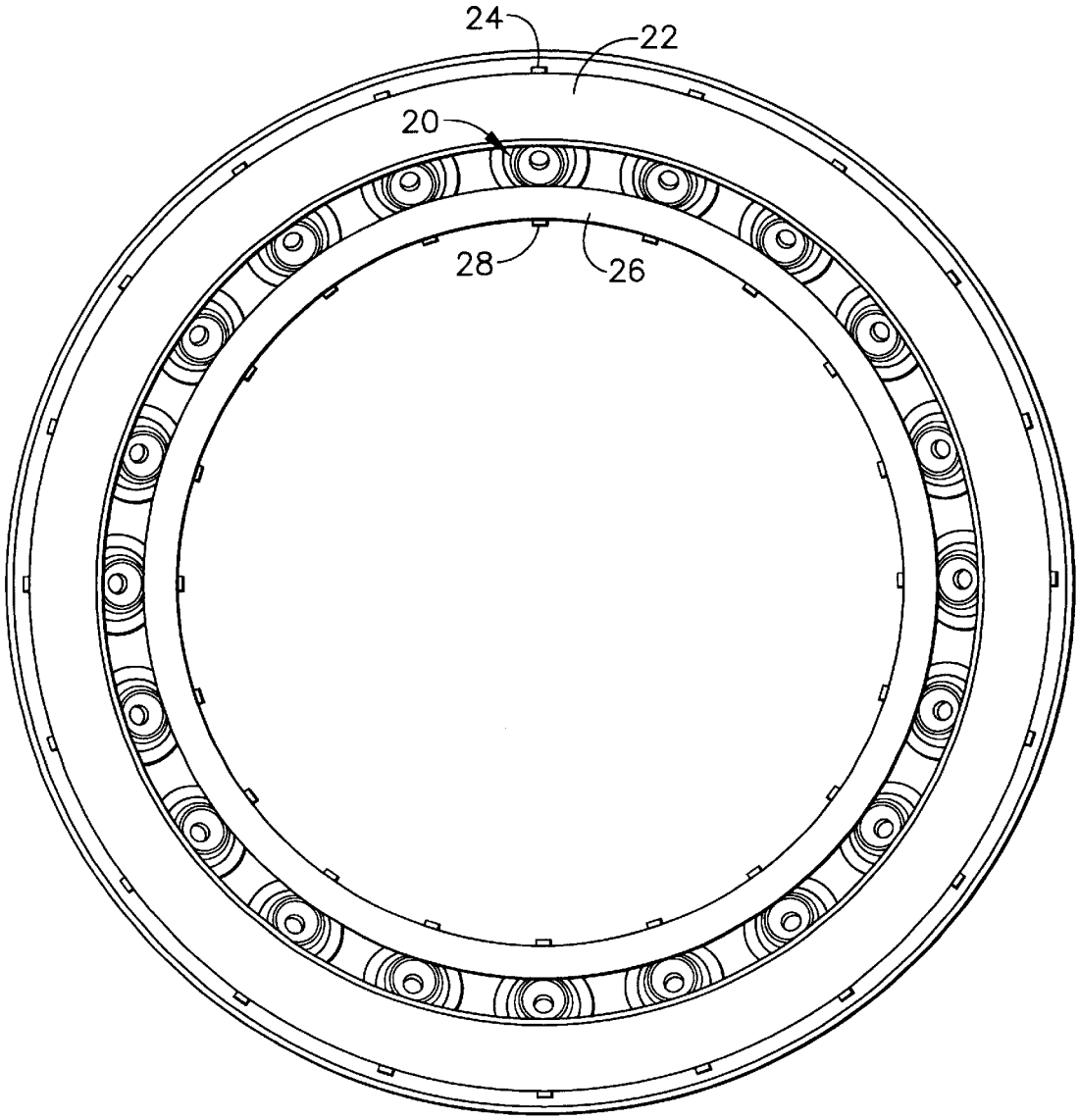
FIG. 2 is a forward looking aft view of the cowl depicted in FIG. 1.

In combustor 10, an outer cowl 22 is provided upstream of combustion chamber 12 and attached to outer liner 14, as well as dome 18, at outer bolted connection 24. An inner cowl 26 is also provided upstream of combustion chamber 12 and attached to inner liner 16, as well as dome 18, at inner bolted connection 28. Outer and inner cowls 22 and 26 perform the function of properly directing and regulating the flow of pressurized air from a diffuser of the gas turbine engine to dome 18 and outer and inner passages 30 and 32 located adjacent outer and inner liners 14 and 16, respectively. It will be understood from FIGS. 1 and 2 that outer and inner cowls 22 and 26 are annular in shape like combustor 10. As is typical with combustor cowls, outer and inner cowls 22 and 26 are axially elongated relative to a central cowl axis 34.

It is desired that outer and inner cowls 22 and 26 be both lightweight and inexpensive. In order to achieve this, outer and inner cowls 22 and 26 preferably are made of sheet metal. The sheet metal material for outer and inner cowls 22 and 26 may include cobalt based alloys and nickel based alloys. In particular, the preferred Aerospace Material Specifications for such cobalt based alloys include AMS5608 and the preferred Aerospace Material Specifications for such nickel based alloys include AMS5536, AMS5878, and AMS5599.

In order to increase the stiffness of outer cowl 22, outer cowl 22 is molded to form annular corrugations 40. By increasing the stiffness to outer cowl 22, the frequency of outer cowl 22 is also increased. There is a proportional correlation of increased stiffness to increased frequency; thus, as stiffness increases, so does the frequency. It is desirable to increase the frequency of outer cowl 22 to a point in which the frequency of outer cowl 22 is higher than the frequency of the engine.

Figure 3:
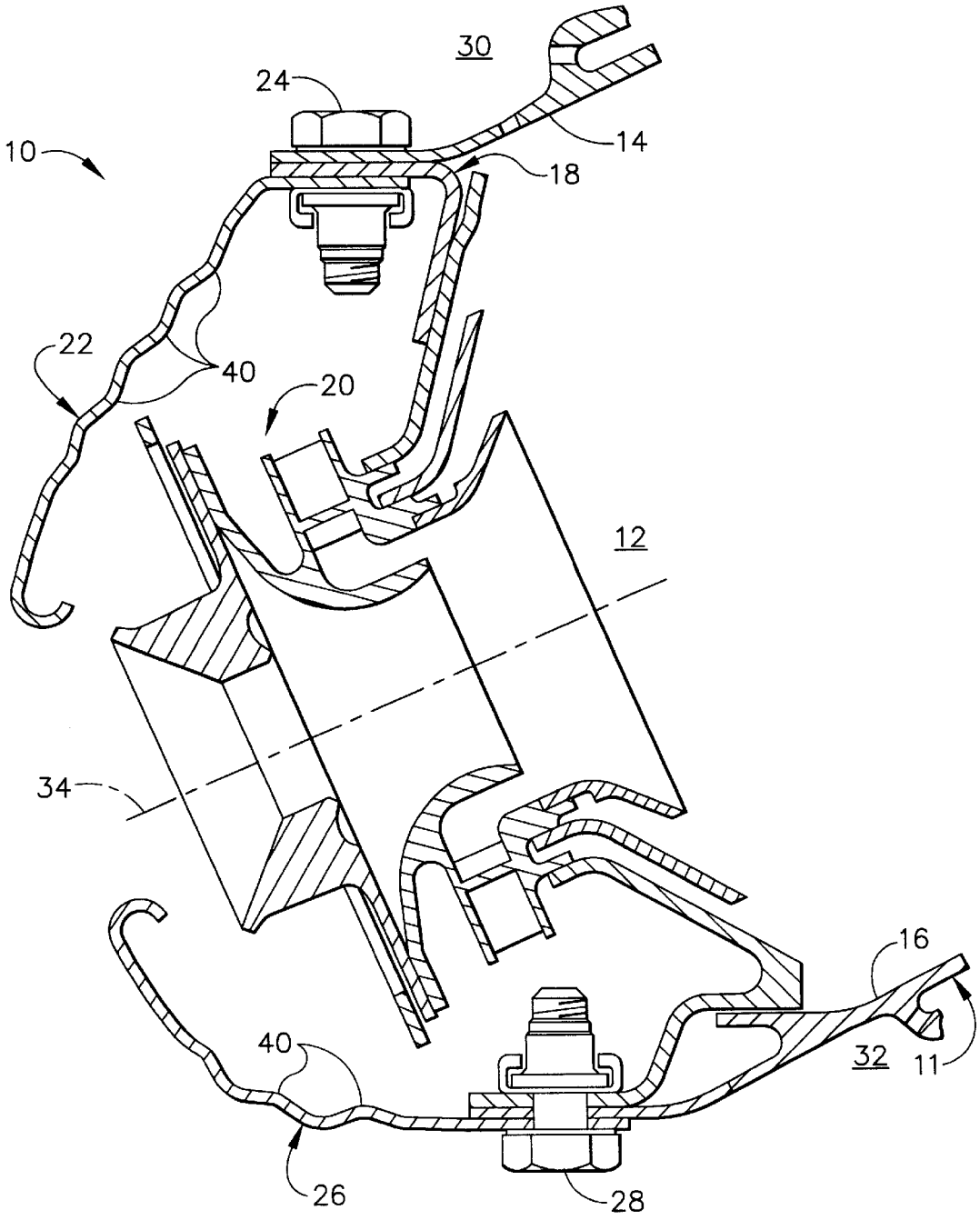
FIG. 3 is a longitudinal cross-sectional view of a gas turbine engine combustor including an outer cowl with annular corrugations and an inner cowl with annular corrugations.
Figure 4:
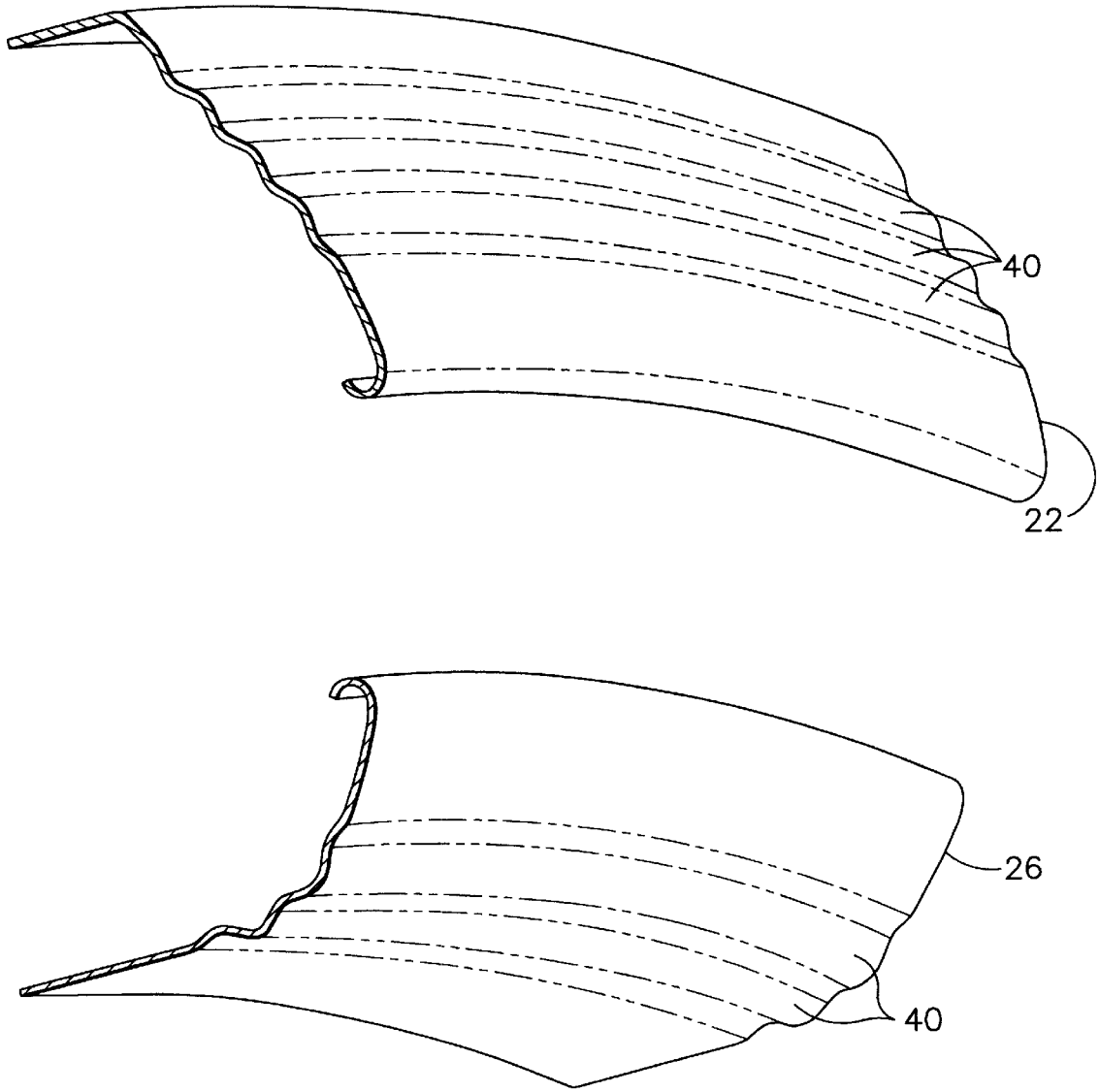
FIG. 4 is a forward looking aft isometric view of both a corrugated outer cowl and a corrugated inner cowl.
Figure 5:
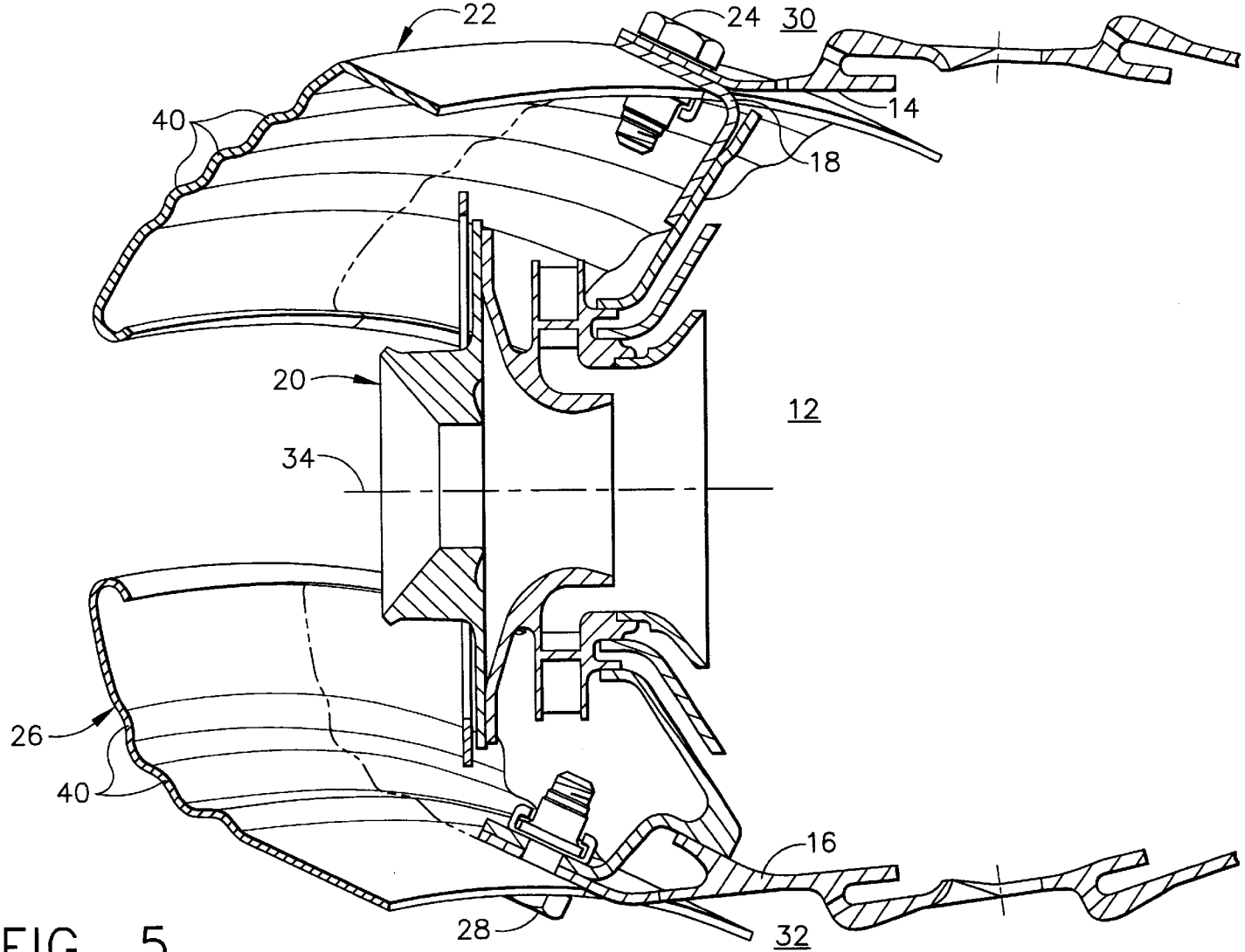
FIG. 5 is an aft looking forward isometric view of the corrugated outer and inner cowls of FIG. 3.

Referring to FIG. 3, in an alternative embodiment, both outer and inner cowls 22 and 26 are formed with annular corrugations 40. FIGS. 4 and 5 illustrate isometric views of outer and inner cowls 22 and 26 with annular corrugations 40.

Figure 6:
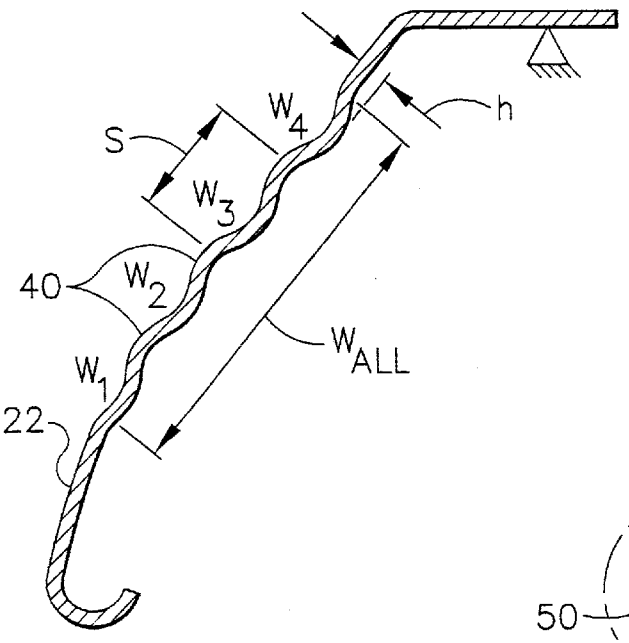
FIG. 6 is an enlarged, partial cross-sectional view of the corrugated cowl depicted in FIG. 1.

FIG. 6 illustrates the various parameters to forming annular corrugations in outer cowl 22. When molding annular corrugations 40, there are three parameters to annular corrugations 40: (a) the number of annular corrugations in outer cowl 22, which is shown as $w_1$, $w_2$, etc., with the total number of annular corrugations represented by $w_{all}$; (b) the height of each annular corrugation 40, which is shown as "h"; and (c) the spacing of each annular corrugation 40, which is shown as "s". The two important parameters for forming annular corrugations 40 are the spacing, s, and the height, h, of annular corrugations 40. The spacing and height of annular corrugations are optimized so that the natural frequency of outer cowl 22 is increased to outside the engine operating range. The number of corrugations in outer cowl 22 does not significantly affect the stiffness of outer cowl 22.

In an exemplary embodiment, the spacing of annular corrugations is from about 0.010 inches to about 0.500 inches, with a preferred spacing of about 0.080 inches. The height of annular corrugations is from about 0.010 inches to about 0.050 inches, with a preferred height of about 0.0334 inches. By forming annular corrugations with the spacing and height in the above-indicated range, the stiffness of outer cowl 22 is increased so that the frequency of outer cowl 22 is increased to outside a typical engine operating range.

Figure 8:
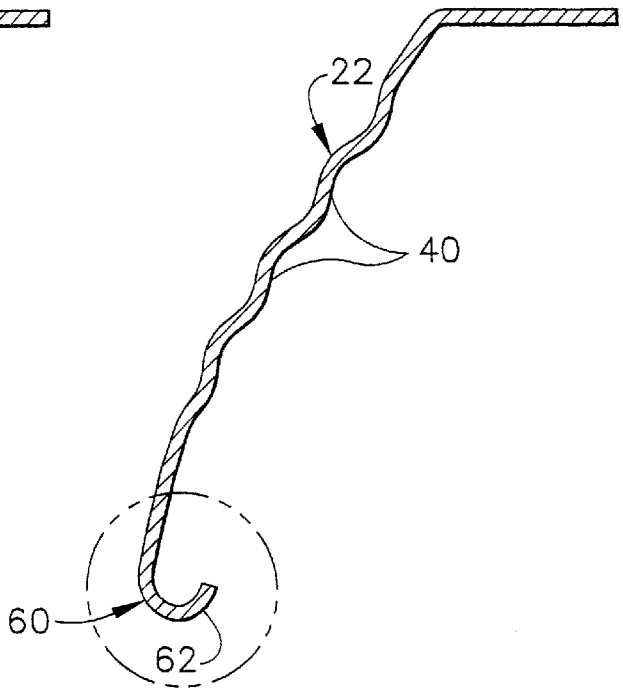
FIG. 8 is an alternative embodiment of an enlarged, partial cross-sectional view of the corrugated outer cowl depicted in FIG. 1 illustrated with a partial wrap.
Figure 7:
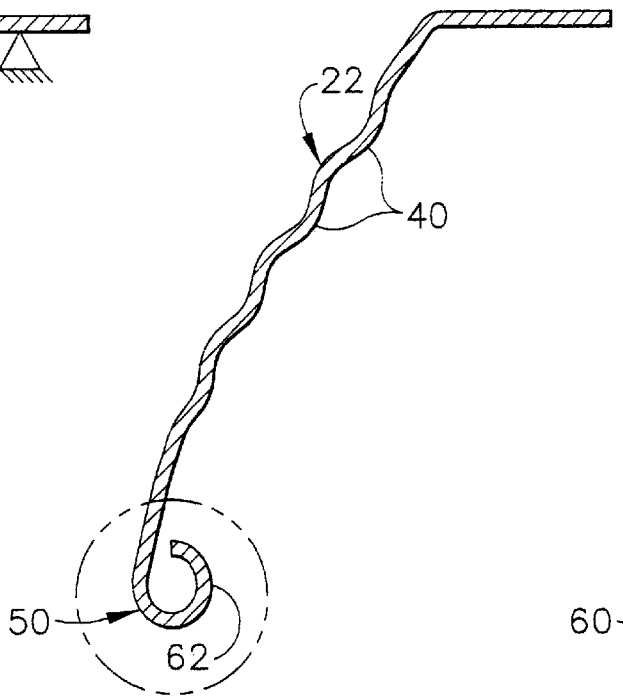
FIG. 7 is an enlarged, partial cross-sectional view of the corrugated cowl depicted in FIG. 1 illustrated with a full wrap.

FIGS. 7 and 8 illustrate outer cowl 22 with annular corrugations with outer cowl 22 being formed with a full wrap 50 (FIG. 7) or a partial wrap (FIG. 8). Both full wrap 50 and partial wrap 60 are located at a first end 62 of outer cowl 22. First end 62 is the end in which the air enters the combustor 10 (see FIG. 1). By providing for full wrap 50 or partial wrap 60 at first end 62, there is a smooth surface as the air enters the combustor, which provides for improved aerodynamics. While either type of wrap may be utilized with outer cowl 22, partial wrap 60 is preferred because there is less forming of the body of outer cowl 22 to form partial wrap 60.

Outer cowl 22 with annular corrugations 40 sustains the stress levels imposed thereon for a desirable number of hours without succumbing to high cycle fatigue and directs air flow to the combustor in a manner consistent with the requirements of the fuel/air mixers and the inner/outer passages. Outer cowl 22 with annular corrugations 40 is both lightweight and inexpensive in terms of materials, processing and specific fuel consumption. Moreover, by incorporating annular corrugations 40 into outer cowl 22, the damper wire (not shown) of prior art cowls can be eliminated. Also, inner cowl 26 may also have annular corrugations 40, which would have the same effect as on outer cowl 22. Desired air flow into combustor 10 is typically difficult to achieve, and may be affected by any change in design for outer cowl 22. The benefit of including corrugations into outer cowl 22 is that there is little to no impact on desired air flow into combustor 10, including the passage pressure recoveries.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A cowl on a combustor of a gas turbine engine, the cowl comprises annular corrugations formed in an inside surface of said cowl.

2. The cowl of claim 1, said cowl has a main body that is made of sheet metal.

3. The cowl of claim 1, wherein the cowl is an outer cowl.

4. The cowl of claim 1, wherein the cowl is an inner cowl.

5. The cowl of claim 1, wherein said annular corrugations has a spacing between each annular corrugation.

6. The cowl of claim 5, wherein said spacing is about 0.010 inches to about 0.500 inches.

7. The cowl of claim 5, wherein said spacing is about 0.080 inches.

8. The cowl of claim 1, wherein said annular corrugation has a height.

9. The cowl of claim 8, wherein said height is from about 0.010 inches to about 0.050 inches.

10. The cowl of claim 8, wherein said height is about 0.0334 inches.

11. The cowl of claim 1, further comprising a partial wrap disposed at a first end of said cowl.

12. The cowl of claim 1, further comprising a full wrap disposed at a first end of said cowl.

13. A combustor of a gas turbine engine, the combustor comprising:

a hollow body defining a combustion chamber, said hollow body having a liner;

an outer cowl having annular corrugation formed in an outer surface and an inner surface of said outer cowl, said outer cowl connecting to said liner; and an inner cowl connecting to said liner.

14. The combustor of claim 13, wherein said inner cowl has an inner annular corrugation.

15. The combustor of claim 13, wherein said outer cowl has main body that is made of sheet metal.

16. The combustor of claim 13, wherein said annular corrugations has a spacing between each annular corrugation.

17. The combustor of claim 16, wherein said spacing is about 0.01 inches to about 0.50 inches.

18. The combustor of claim 16, wherein said spacing is about 0.080 inches.

19. The combustor of claim 13, wherein said annular corrugation has a height.

20. The combustor of claim 19, wherein said height is from about 0.010 inches to about 0.050 inches.

21. The combustor of claim 19, wherein said height is about 0.0334 inches.

22. The combustor of claim 13, further comprising a partial wrap disposed at a first end of said outer cowl.

23. The combustor of claim 13, further comprising a full wrap disposed at a first end of said outer cowl.

24. The combustor of claim 13, further comprising a mixer disposed between said outer cowl and said inner cowl.

25. A method of configuring a cowl for a gas turbine engine combustor, the method comprising forming annular corrugations in an inside surface and an outside surface of a main body of the cowl.

26. The method of claim 25, further comprising spacing said annular corrugations from about 0.01 inches to about 0.5 inches apart.

27. The method of claim 25, further comprising spacing said annular corrugations about 0.08 inches apart.

28. The method of claim 25, further comprising forming said annular corrugation with a height of between 0.01 inches to about 0.05 inches.

29. The method of claim 25, further comprising forming said annular corrugation with a height of about 0.0334 inches.

30. The method of claim 25, further comprising forming a partial wrap at a first end of said main body.

31. The method of claim 25, further comprising forming a full wrap at a first end of said main body.

* * * * *